US007712458B2

(12) United States Patent
Olsson

(10) Patent No.: US 7,712,458 B2
(45) Date of Patent: May 11, 2010

(54) METHOD AND APPARATUS FOR RAISING THE SPARK ENERGY IN CAPACITIVE IGNITION SYSTEMS

(75) Inventor: Johan Olsson, Åmål (SE)

(73) Assignee: SEM Aktiebolag, Amal (SE)

( * ) Notice: Subject to any disclaimer, the term of this patent is extended or adjusted under 35 U.S.C. 154(b) by 22 days.

(21) Appl. No.: 12/281,654

(22) PCT Filed: Apr. 2, 2007

(86) PCT No.: PCT/SE2007/050206

§ 371 (c)(1),
(2), (4) Date: Sep. 22, 2008

(87) PCT Pub. No.: WO2007/114783

PCT Pub. Date: Oct. 11, 2007

(65) Prior Publication Data

US 2009/0056685 A1 Mar. 5, 2009

(30) Foreign Application Priority Data

Apr. 3, 2006 (SE) ..... 0600752

(51) Int. Cl.
*F02P 3/09* (2006.01)

(52) U.S. Cl. ..... 123/604; 123/596; 123/600; 123/620

(58) Field of Classification Search ..... 123/596, 123/600, 604, 620
See application file for complete search history.

(56) References Cited

U.S. PATENT DOCUMENTS 3,855,984 A * 12/1974 Jacobs ..... 123/598
4,562,823 A * 1/1986 Moritugu et al. ..... 123/620
5,050,553 A * 9/1991 Erhard ..... 123/406.54
5,207,208 A * 5/1993 Ward ..... 123/596
5,220,901 A * 6/1993 Morita et al. ..... 123/604
5,531,206 A 7/1996 Kitson
6,701,904 B2 * 3/2004 Lepley ..... 123/604
7,121,270 B1 * 10/2006 Plotnikov ..... 123/604
7,137,385 B2 * 11/2006 Newton ..... 123/630
7,404,396 B2 * 7/2008 Toriyama et al. ..... 123/598
7,546,836 B2 * 6/2009 Andersson et al. ..... 123/605

FOREIGN PATENT DOCUMENTS

EP 0243330 A2 10/1987
JP 56032075 A 4/1981
JP 58131358 A 8/1983
JP 60067769 A 4/1985
JP 61255272 A 11/1986

* cited by examiner

*Primary Examiner*—Erick Solis
(74) *Attorney, Agent, or Firm*—Jeffrey S. Melcher; Manelli Denison & Selter PLLC

(57) ABSTRACT

The present invention refers to an apparatus for raising the spark energy in capacitive ignition systems comprising at least one charge winding (L1) which via a first rectifier device (D1) charges a charge capacitor (C1) connected to the primary winding of an 5 ignition voltage transformer in order to provide said primary winding with energy for generation of a spark characterized in that additionally a second rectifier device (D2) and a switching device (Q2) are arranged in such a way that the switching device periodically can short circuit the charge winding and thereby increase the charge of the charge capacitor at low engine speeds.

7 Claims, 5 Drawing Sheets

METHOD AND APPARATUS FOR RAISING THE SPARK ENERGY IN CAPACITIVE IGNITION SYSTEMS

This application is a national stage entry filed under 35 U.S.C. 371 of PCT/SE2007/050206, filed on Apr. 2, 2007 and pending. The application further claims foreign priority under 35 U.S.C. 119 and 365 from application 0600752-0 filed in Sweden on Apr.3, 2006.

TECHNICAL FIELD

The present invention refers to a method and an apparatus for raising the spark energy, especially in small so called "Capacitive Discharge Ignition (CDI)" systems without batteries for combustion engines at which the ignition voltage is generated by means of a generator and associated control circuitry connected to or integrated in the flywheel.

The invention can be implemented without the necessity of changing external conditions as e.g. the intensity of magnetisation, iron cores etc. in an existing generator. More generally the idea of the invention could be used in order to create a more powerful voltage generation especially at small mobile internal combustion engine systems.

BACKGROUND ART

The method and the apparatus have special application at small, mobile, manually started internal combustion engine powered devices as e.g. accessories of different types as chainsaws, lawnmowers and outboard motors and the like. Especially at low speed, e.g. at start of such accessories, conventional ignition systems have difficulties to deliver sufficient spark energy in order to ensure a quick and reliable start.

The patent document U.S. Pat. No. 6,701,896 shows a method by means of which the burning time for the spark could be prolonged which gives an increase of the energy. But the method only gives small or no additions of energy at low speed.

BRIEF DESCRIPTION OF THE INVENTION

The object of the invention is to considerably raise the available energy in the spark by means of a very cost effective circuit according to the idea of the invention. This is especially true for low speeds, e.g. at start, when the problem with low spark energy is particularly accentuated.

The method according to the invention makes it possible to use energy which in known conventional systems simply is not taken care of. Conventional CDI systems, cf. for instance U.S. Pat. No. 6,701,896 and the following description, have a so called "charge winding" arranged on an iron core in a magnetic circuit which is activated once per engine rotation.

The induced voltage over this charge winding is charging a capacitor via a rectifier with energy once per engine rotation. The capacitor is then cyclically decharged through another winding on the same or another iron core which constitutes the primary winding of a transformer and the associated secondary winding generates spark voltage to a sparkplug.

The voltage over the charge winding is mainly proportional to the number of turns of the winding and the rotation speed of the engine. On one hand one wishes a high number of turns on the charge winding at low engine speeds in order to create an acceptable charge voltage and on the other hand one would have wished a lower number of turns at high engine speeds in order not to expose the capacitor for overvoltages.

The method and apparatus according to the invention gives a possibility for instance to optimise the number of turns of the charge winding for high engine speeds and at the same time it gives a possibility to keep a good charge level on the capacitor at lower engine speeds.

This is achieved by adding two relatively low cost components to the conventional circuit—namely one additional rectifier diode and one transistor which can short circuit the charge winding. Due to the fact that the charging pulse from the charge winding is relatively long at low engine speeds it is possible by means of switching said transistor on and off at a certain frequency to make the charging procedure for the capacitor more efficient at the same time as the additional energy is controlled so that the charge voltage over the capacitor is not reaching harmful levels.

In the future environmental demands could require small engines of the type here discussed to be provided with fuel injection systems in stead of carburettors. This gives better possibilities to supervise and control the combustion, i.e. you get more power, less fuel consumption, cleaner exhaust gases etc. One problem with switching to fuel injection systems is that these systems require considerably more energy. The fuel has as we know to be pressed into the cylinder during the compression phase. This is usually done by means of an electrically powered injector which requires considerable energy. Due to the fact that at mobile, portable systems, in view of the weight, one does not wish to add a battery, the flywheel related generator must consequently deliver this energy. Irrespective of how one chooses to design this generator it will be necessary to optimise the same for delivering a lot of energy to an injection system at considerably lower voltage than what is required for charging of the charge capacitor of the CDI system. Also this problem can be addressed by means of the method according to the invention, i.e. a low voltage winding could by means of the method according to the invention generate a "high voltage" to the charge capacitor.

An additional advantage with the method and apparatus according to the invention is that the existing so called environmental friendly fuels (e.g. E85) with different additions of ethanol could be used without the operation being affected by as serious problems as with a conventional ignition system. The start of a cold engine with some kind of ethanol fuel requires higher spark energy than the start with pure gasoline due to the fact that the vaporisation of ethanol is definitely inferior and therefore has a less good inflammability.

An additional advantage with the invention is that said additional transistor which will be apparent from the following could be used in order to limit or completely turn off the charging function. This fact could be used in order to provide a so called "one-push-stop"-function at which an instantaneous pressing of a button is detected which is used for completely short-circuiting the charge winding by means of the transistor so that no energy reaches the charge capacitor which causes the engine to stop.

By means of the transistor the voltage level of the charge capacitor could also be controlled. The control could for instance be carried out according to the following: At low engine speed the additional transistor will be pulsed according to diagram 2 for increasing the charge voltage. When the speed increases and is approaching for instance 5-6000 rpm the opposite problem could arise—that is the voltage over the charge capacitor reaches levels which could exceed the rated voltage of the capacitor in which situation the transistor could be used to short circuit part of the charge pulse and thereby limit the charge voltage to safe levels.

The present invention which solves the described technical problems with prior known solutions is characterised according to the following claims.

DESCRIPTION OF THE DRAWINGS

Further objects, uses and advantages with the invention will be apparent from the following description which is given with reference to the appended drawings on which.

DESCRIPTION OF EMBODIMENTS

Figure 1:
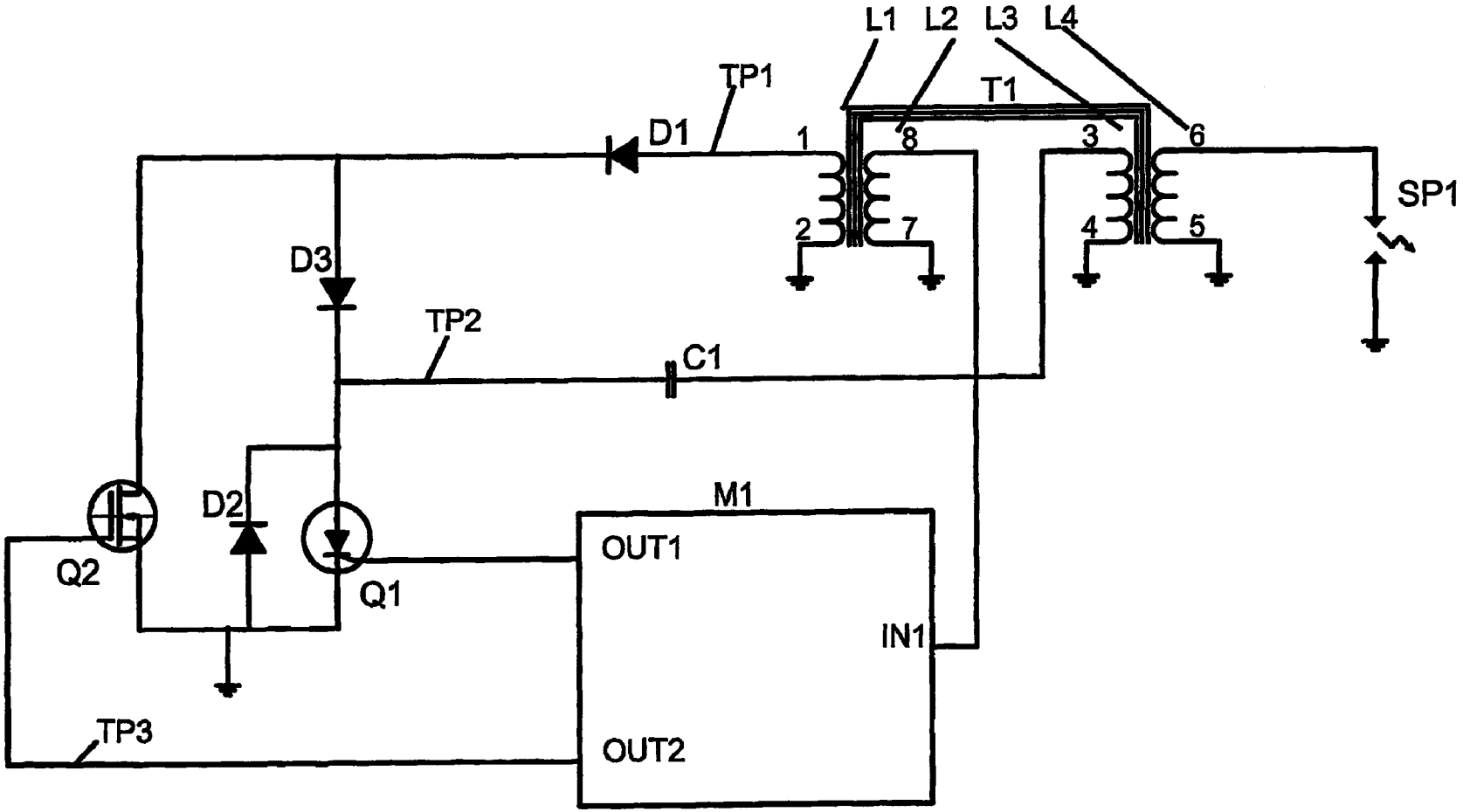
FIG. 1 schematically shows an example of an implementation of the method according to the invention.

In FIG. 1 is schematically shown a circuit diagram in a somewhat simplified form of a typical CDI-system for small engines which has been modified according to the invention. An iron core T1 provided with four conventionally arranged windings is magnetised by means of one or several magnets integrated in the flywheel which at the rotation of the flywheel will sweep past the end portions of the iron core. The variant with several magnets could be used for providing from a generally point of view a more powerful generator which in addition to the function as ignition voltage generator also could be used for other purposes for example fuel injection systems or handle heating on chain saws. The relative magnet movement induces a voltage in the windings L1-4 according to the following.

The winding L1 is the so called charge winding in which is induced a voltage which is used for the spark generation as such. The winding L1 is via one of its end points 1 connected via the rectifier devices D1 and D2 to the charge capacitor C1 in which the energy will be stored until the spark will be activated. The other end point 2 is connected to earth.

The winding L2 is the so called trigger winding. This winding is connected between earth 7 and the input terminal IN1 on the control unit M1 and delivers to this input terminal information about the position and velocity of the flywheel. It could be noted that the control unit M1 is an only slightly modified version of a known conventional control unit.

The winding L3 constitutes the primary winding and L4 the secondary winding of a transformer for generating ignition voltage to the spark plug SP1.

In a conventional way the output terminal OUT1 on the control unit M1 is activated when the ignition voltage should be delivered to the spark plug. The switching device (the thyristor) Q1 the trigger electrode of which is connected to the output terminal OUT1 creates a current path to earth which results in the connection of the voltage over the capacitor C1 to the primary winding L3. Initially a voltage transient is then generated in the secondary winding L4 due to the very high voltage derivative in the test point TP2 at the anode of the thyristor. Immediately thereafter the state in the transformer L3/L4 changes into a damped self-oscillation in which the energy transits between the inductor L3 and the capacitor C1 through the switching device Q1 and the rectifier D2, in the form of a shunt diode D2.

It is also possible to imagine other both resonant and non-resonant circuits for spark generation without departing from the scope of the invention.

The output terminal OUT2 on the control unit M1, which constitutes a modification of a conventional control unit easily made by someone skilled in the art, is connected to the control input terminal on a transistor Q2 the main electrodes of which are connected between earth and the common point between the rectifier devices D1 and D2. Thus, the transistor Q2 can when activated connect the common point between the rectifier devices D1 and D2 to earth and thereby short circuit the winding L1.

The signal at the output terminal OUT2 from the control unit M1 is now arranged in such a way that it during the half period of the induction voltage over the winding L1 at which the charging of the capacitor C1 takes place periodically short circuits the winding L1.

During these periods when Q2 is "on" a current circulates in the circuit L1/Q2 by means of the induction from the magnet in the flywheel—which are followed by a period when Q2 is "off" when the charging of C1 takes place. This method gives, especially at low speeds when the induction in L1 is low but long lasting, the possibility to charge C1 to much higher voltage than what is in reality induced in L1.

The components required for implementation of the method according to the invention on a conventional CDI-system are merely the extra rectifier device/diode D3 and the transistor Q2 and suitable supplementary logic in the control unit M1 in order to drive the output OUT2.

This supplementary logic is elementary and could easily be implemented by anyone skilled in the art and creates only a negligible increase of the complexity of the control unit M1.

The transistor Q2 does not have to be a MOSFET-transistor as in this example and neither have the rectifier devices D1/D3 to be implemented exactly as the circuit diagram indicates—it would for instance be possible to replace D1 with a complete rectifier bridge without departing from the scope of the inventive method.

Figure 2A:
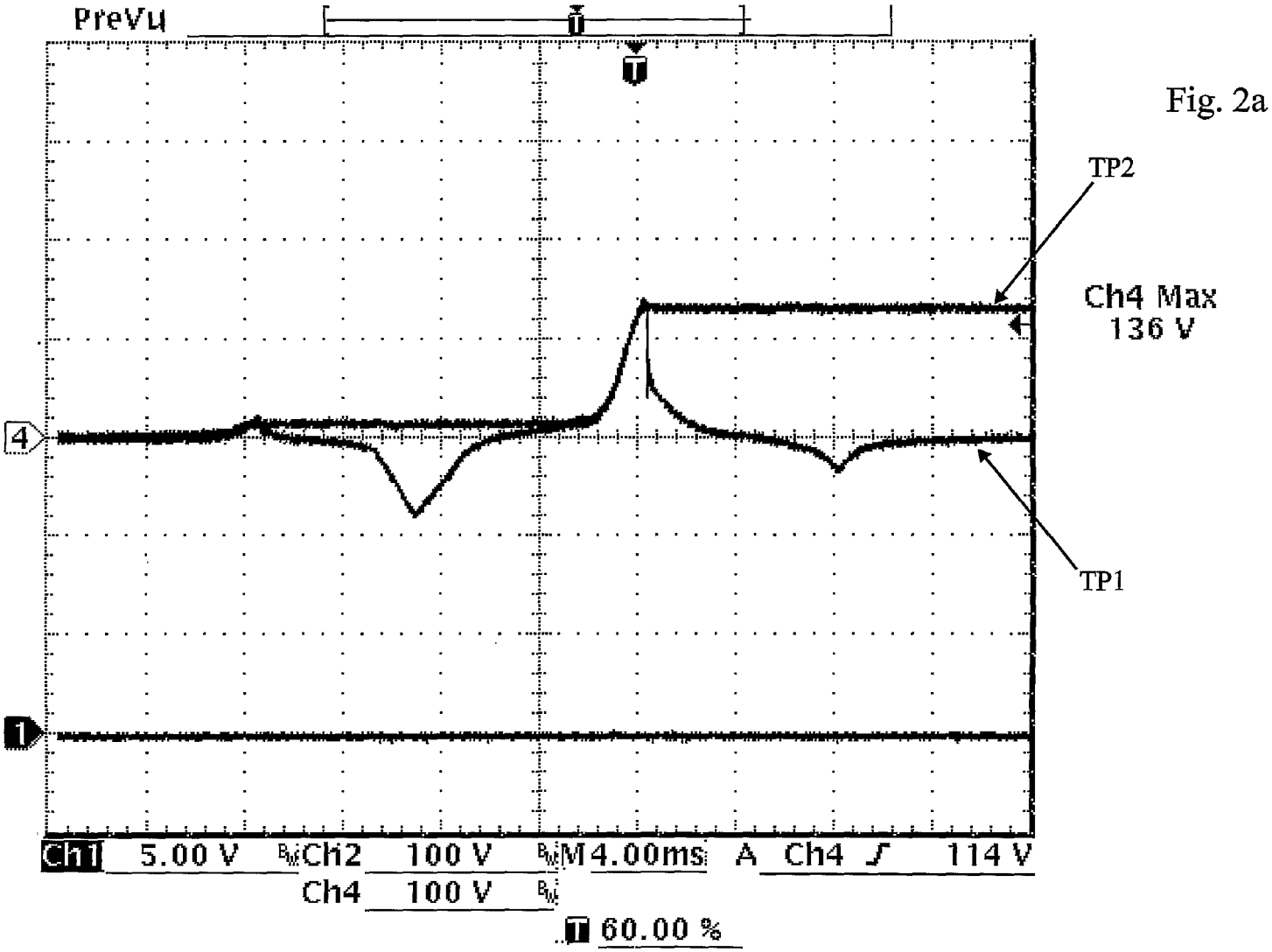
FIGS. 2*a* and 2*c* show waveforms at two measuring points in a conventional circuit.
Figure 2B:
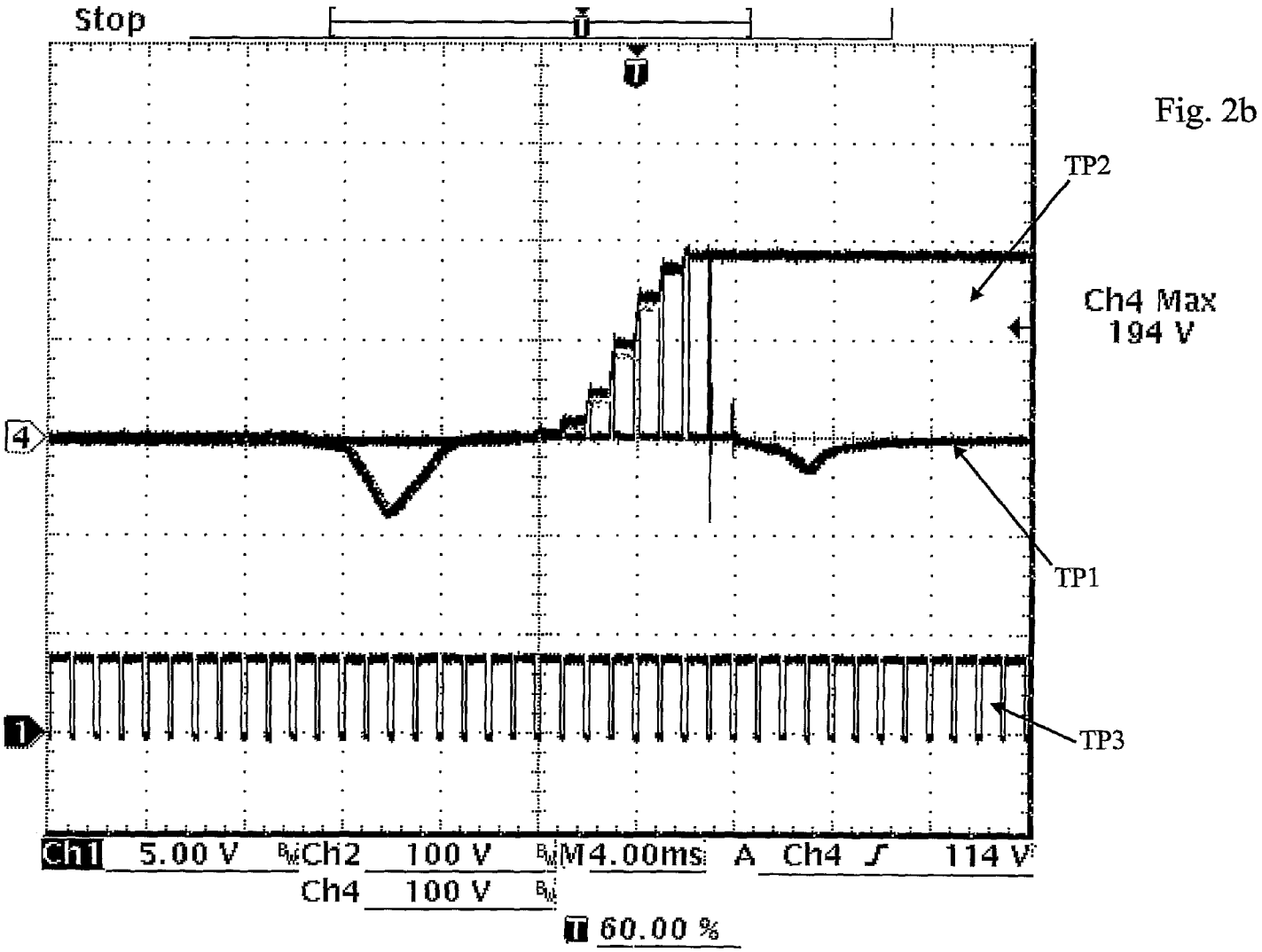
FIGS. 2*b* and 2*d* show corresponding waveforms in a circuit according to the invention.

In FIGS. 2*a* and 2*b* respectively are shown voltage as a function of time at the test points TP1, 2, 3 in the circuit diagram according to FIG. 1 at the engine speed of 600 rpm. FIG. 2*a* shows a conventional charge procedure in which only one rectifier diode is used for the charging and FIG. 2*b* shows charging with the method according to the invention. In the figures is also shown measured values for achieved charge voltage that is an increase from 136V to 194V. As available energy is given by W=C*U2/2 the present example gives with a charge capacitor of 0.47 uF an increase of available energy from 4.3 mWs to 8.8 mWs.

Figure 2C:
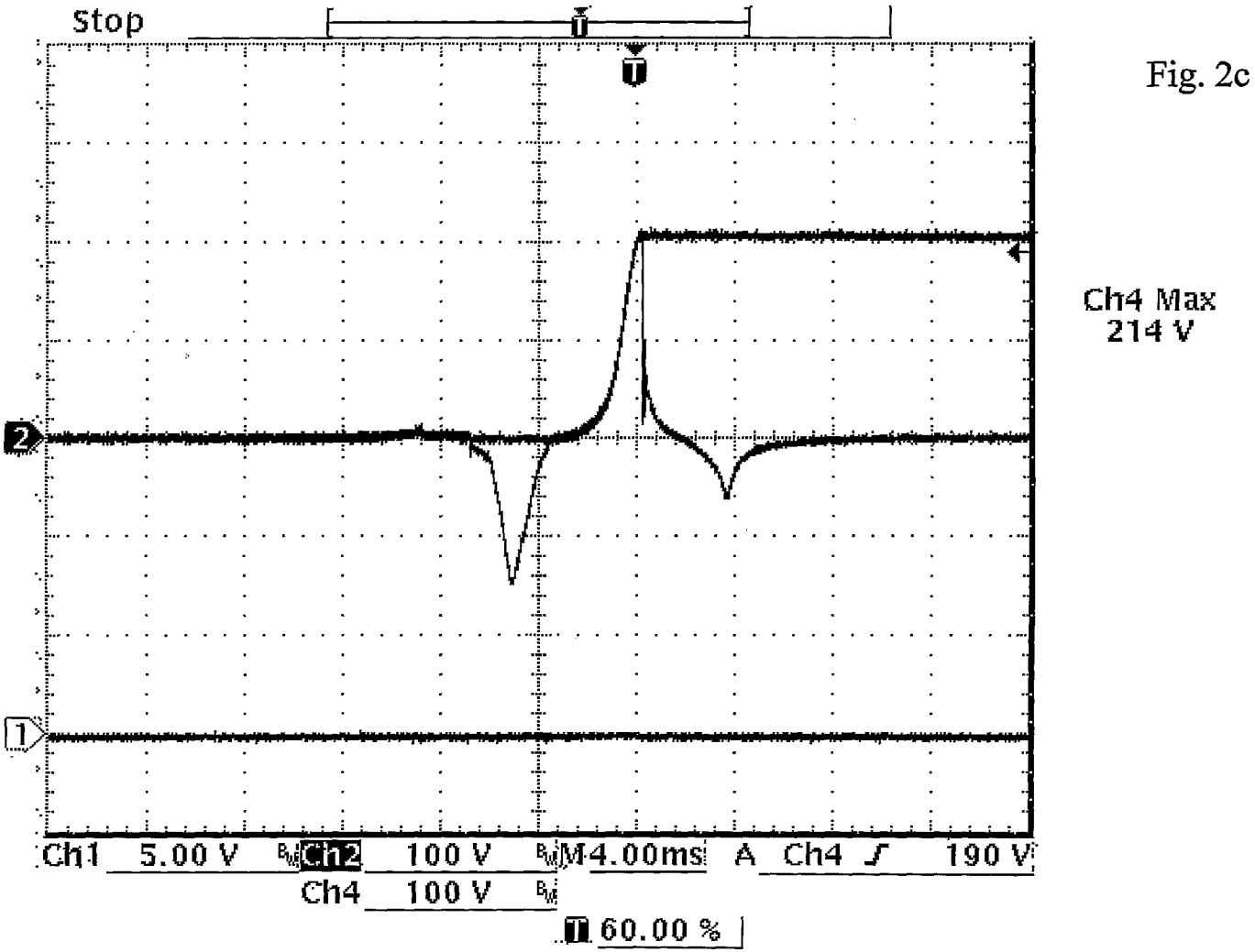
Figure 2D:
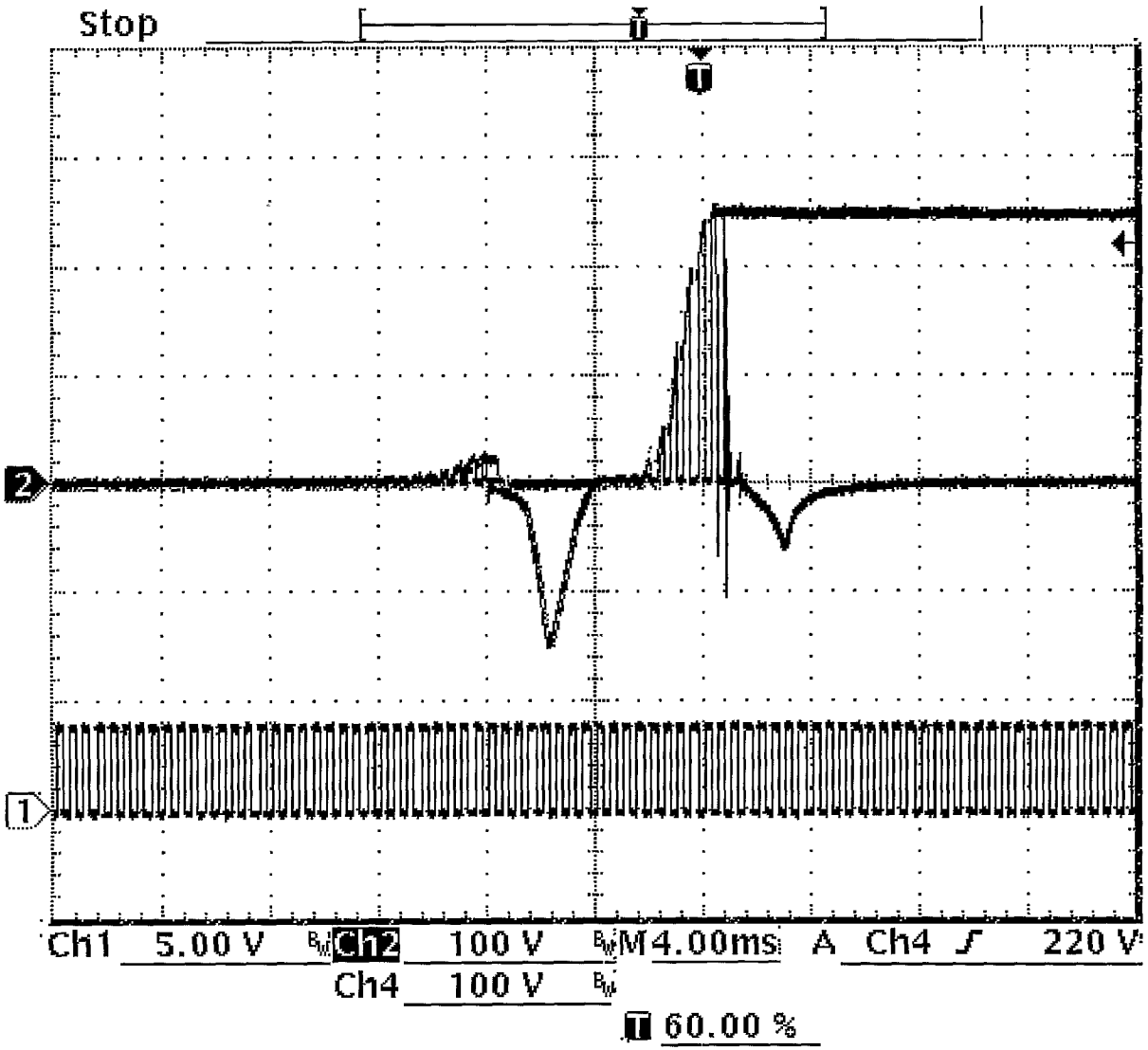

FIGS. 2*c* and 2*d* show the same relations as FIGS. 2*a* and 2*b* but at the speed of 1200 rpm. With the same calculations as above with the voltages 214V and 256V the energy increase will be from 10.7 mWs to 15.4 mWs. Thus, the possible energy gain is rapidly decreasing with increasing speed. This fact is however as a whole compensated by the fact that the charge winding does not any longer have to be optimised for the full speed range. In reality the energy levels will be possible to raise at both high and low engine speeds.

The invention claimed is:

1. Apparatus for raising a spark energy in capacitive ignition systems comprising:

at least one charge winding in communication with a first rectifier device and a charge capacitor for charging the charge capacitor, the charge capacitor being connected to a primary winding of an ignition voltage transformer to provide said primary winding with energy for generation of a spark; and a second rectifier device and switching device in communication with the charge winding device constructed and arranged such that the switching device periodically can short circuit the charge winding and thereby increase the charge of the charge capacitor at low engine speeds.

2. Apparatus according to claim 1, further comprising a control unit constructed and arranged to drive the switching device depending on the engine speed such that charge voltage over the charge capacitor is held on a relatively constant level over a full engine speed range.

3. Apparatus according to claim 1, wherein the switching device is constructed and arranged to create a short circuit over the charge winding in order to stop an engine.

4. Apparatus according to claim 2, wherein the switching device is constructed and arranged to create a short circuit over the charge winding in order to stop an engine.

5. Method for raising a spark energy in capacitive ignition systems comprising:

charging a charge capacitor using a charge winding in communication with a first rectifier device and the charge capacitor;

providing energy from the charge capacitor to a primary winding of an ignition voltage transformer to generate a spark; and periodically short circuiting the charge winding and thereby increasing the charge of the charge capacitor at low engine speeds using a second rectifier device and switching device in communication with the charge winding device.

6. Method according to claim 5, further comprising using a control unit to drive the switching device depending on the engine speed such that charge voltage over the charge capacitor is held on a relatively constant level over a full engine speed range.

7. Method according to claim 5, further comprising stopping an engine by using the switching device to create a short circuit over the charge winding.

* * * * *

UNITED STATES PATENT AND TRADEMARK OFFICE

CERTIFICATE OF CORRECTION

PATENT NO. : 7,712,458 B2
APPLICATION NO. : 12/281654
DATED : May 11, 2010
INVENTOR(S) : Olsson It is certified that error appears in the above-identified patent and that said Letters Patent is hereby corrected as shown below:

In lines 3 and 5 of column 4, the term "D2" should be replaced with "D3".

Accordingly, column 4, lines 3-5 should read "between the rectifier devices D1 and D3. Thus, the transistor Q2 can when activated connect the common point between the rectifier devices D1 and D3 to earth and thereby short".

Signed and Sealed this
Sixth Day of March, 2012

David J. Kappos

David J. Kappos
*Director of the United States Patent and Trademark Office*